United States Patent [19]

Jackson

[11] 4,274,953

[45] Jun. 23, 1981

[54] VIBRATING SCREEN SEPARATOR

[75] Inventor: Allen S. Jackson, Atlanta, Ga.

[73] Assignee: J & H Equipment, Inc., Roswell, Ga.

[21] Appl. No.: 153,454

[22] Filed: May 27, 1980

[51] Int. Cl.[3] ..... B07B 1/38; B07B 1/42

[52] U.S. Cl. ..... 209/326; 209/366.5

[58] Field of Search ..... 209/367, 366.5, 326, 209/315, 314, 365 R; 198/761, 770; 74/87, 61; 366/116

[56] References Cited

U.S. PATENT DOCUMENTS

| | | | |
|---|---|---|---|
| 2,531,706 | 11/1950 | Signeul | 209/367 X |
| 2,804,967 | 9/1957 | Hyslop | 198/761 |
| 2,936,064 | 5/1960 | Schuessler | 198/761 |
| 2,965,233 | 12/1960 | Muller | 209/326 X |
| 3,040,891 | 6/1962 | Saxe | 209/367 |
| 3,053,379 | 9/1962 | Roder | 209/367 X |
| 3,053,380 | 9/1962 | Spurlin | 198/761 X |
| 3,253,701 | 5/1966 | Evans | 198/761 |
| 3,346,097 | 10/1967 | Carrier | 198/761 |
| 3,468,418 | 9/1969 | Renner | 209/366.5 X |
| 3,604,555 | 9/1971 | Cowper | 209/367 X |

*Primary Examiner*—Ralph J. Hill

*Attorney, Agent, or Firm*—Newton, Hopkins & Ormsby

[57] ABSTRACT

Opposing rotationally adjustable vibration motors mounted externally to opposite side walls of a rectangular or circular separator greatly facilitates access to the motors for servicing and/or replacement and enables varying the intensity of vibration of the separator screen over a wide range while motor speed remains constant. Simplicity of construction, compactness and ruggedness of motor mountings is achieved.

3 Claims, 6 Drawing Figures

VIBRATING SCREEN SEPARATOR

BACKGROUND OF THE INVENTION

Generally, in the prior art, vibrating screen separators have employed a single centrally located vibration motor which is quite inaccessible for repair or replacement. Additionally, in some cases, it is not possible to vary the speed of the single motor to effect variation of the frequency or amplitude of vibration imparted to the screen by the motor.

The main objective of this invention is to cure these defects of the prior art by providing, on a screen separator, two opposing vibration motors which counter-rotate and which are independently rotationally adjustable on the separator frame through a full 360 degrees in planes which are parallel to the axes of rotation of the vibration motors. The two motors can be bodily rotated in unison or relative to each other to produce various vibrational effects on the screen separator including dampening the screen vibration or intensifying vibration both as to frequency and amplitude through a significant range without changing the speed of rotation of the motors. The two motors are on the exterior of the frame containing the vibrating screen at opposite sides thereof and are thus easily accessible for servicing or replacement.

In addition to eliminating the stated drawbacks of the prior art, the invention further seeks to provide a vibrating screen separator of greater efficiency in that greater quantities of material can pass through the separator screen during a shorter period of operation. This objective can be achieved for varying types of divided solids by increasing or decreasing the intensity of vibration through rotational adjustment of the two motors. When desirable, the product can be made to bounce on the screen while simultaneously having induced movement parallel to the plane of the screen. In this manner, the versatility of use of the screen separator is greatly enhanced. The unique dual vibration motor mounting arrangement is equally applicable to inclined rectangular screen separators or upright axis circular separators.

Other objects and advantages of the invention will become apparent to those skilled in the art during the course of the following description.

DETAILED DESCRIPTION

Figure 1:
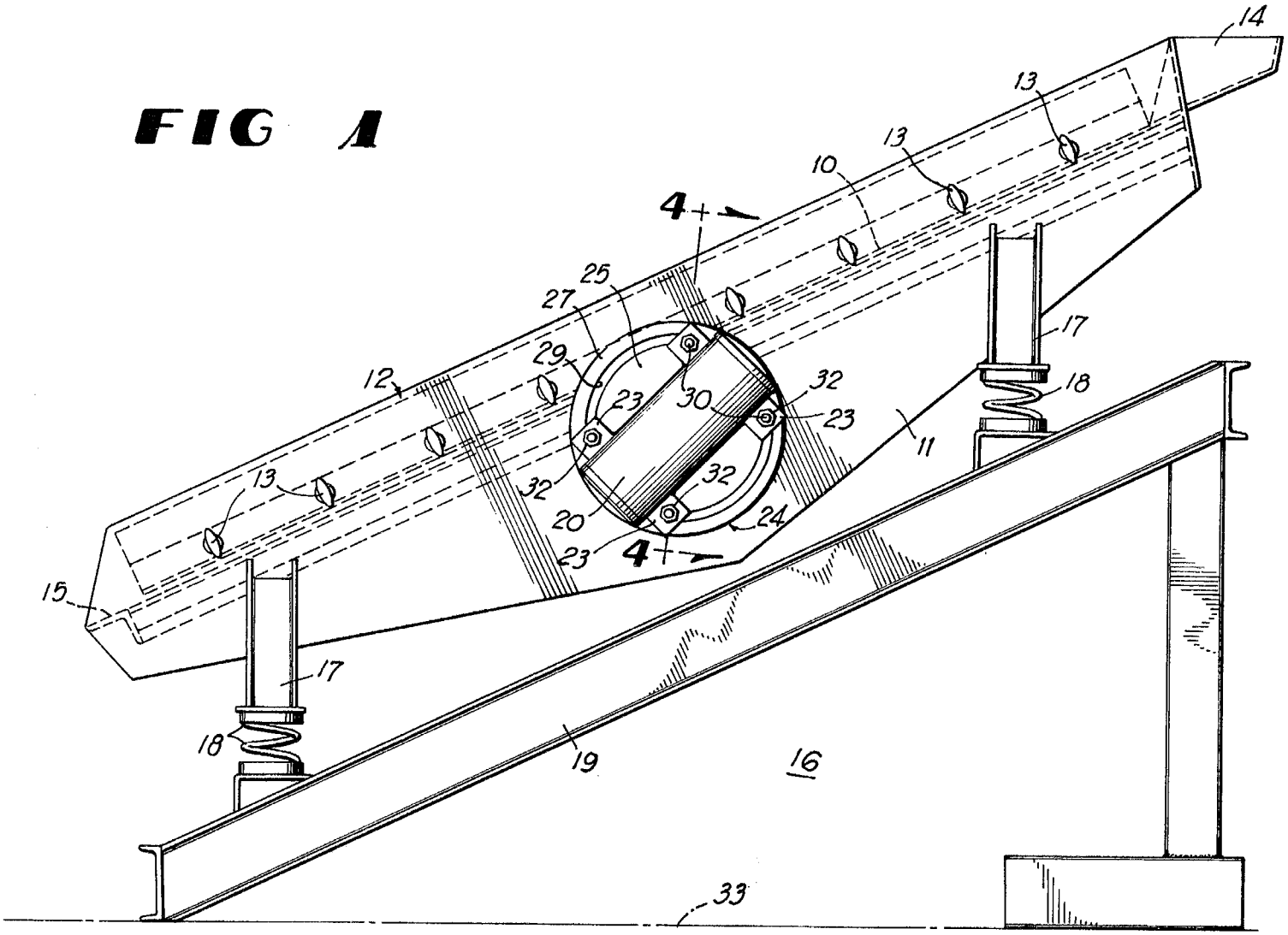
FIG. 1 is a side elevation of the invention as embodied in an inclined vibrating screen separator.
Figure 2:
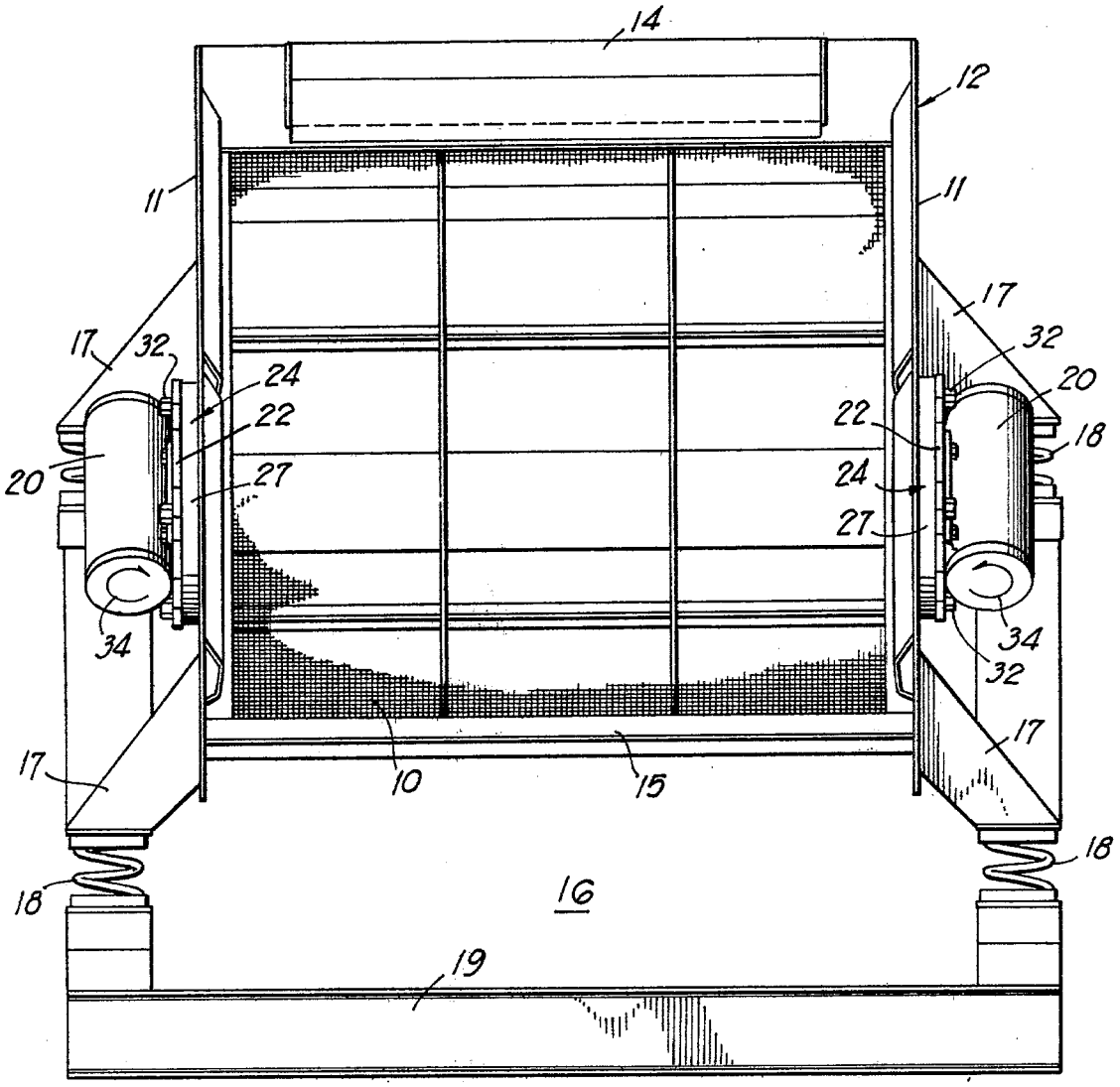
FIG. 2 is an end elevation of the separator in FIG. 1.

Referring to the drawings in detail wherein like numerals designate like parts, a conventionally constructed rectangular separator screen 10, FIGS. 1 and 2, is held between the parallel side walls 11 of an upper vibration frame 12. The screen proper is secured within the frame 12 by multiple turnbuckle means 13 accessible at the two sides of the frame 12. The vibration frame 12 is inclined, as shown, and is equipped at its upper end with a material input chute 14, the lower discharge end of the frame 12 being indicated by the numeral 15. The space 16 beneath the screen separator is unobstructed so that a conveyor or other collector means can occupy this space and receive material passing through the vibrating screen.

The upper frame 12 carries depending divergent legs 17 resting on coil spring vibration supports 18, in turn mounted on a relatively stationary base frame or bed 19, as illustrated. In this manner, the vibration frame 12 with its separator screen 10 is bodily and floatingly supported on the spring means 18 for vibratory movement in any direction or compound directions dictated by the adjustment of vibration motor means in accordance with a key aspect of the invention.

Figure 3:
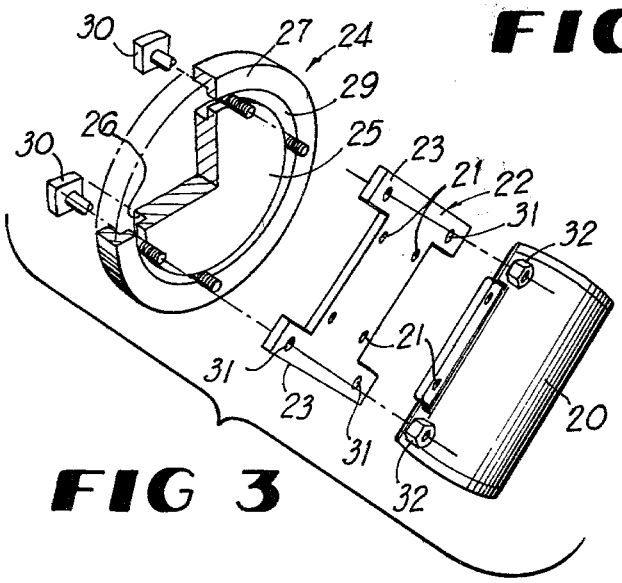
FIG. 3 is an exploded perspective view of an adjustable vibration motor mount.
Figure 4:
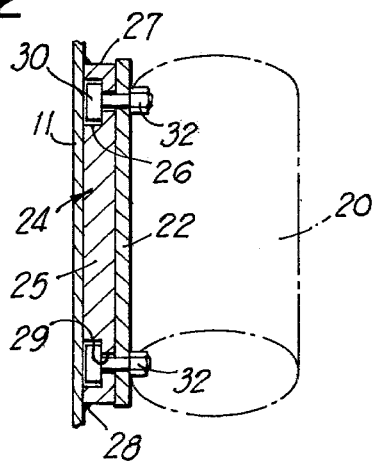
FIG. 4 is an enlarged vertical section taken on line 4—4 of FIG. 1.

The vibration motor means comprises a pair of counter-rotating conventional vibration motors 20 mounted on the exterior of the opposite side walls 11 of vibration frame 12. By virtue of this external side mounting, the two motors 20 are immediately accessible for adjustment, repair or replacement. Each motor 20, FIGS. 3 and 4, is attached by a suitable fastener means at 21 to a motor mounting plate 22 having apertured end extensions 23. A coacting two-part motor mount 24 for each vibration motor 20 consists of a center disc 25 having an annular marginal step groove 26. Surrounding the disc 25 in spaced concentric relation thereto is an L-cross sections ring 27. The disc 25 and ring 27 are preferably welded to the adjacent side wall 11.

An annular T-cross section passage 29 is created between the two elements 25 and 27 for the reception of T-bolts 30, whose shanks are received through apertures 31 in extensions 23. The T-bolt shanks can travel in either direction through annular passage 29 when their locking nuts 32 are released. The locking nuts 32 for T-bolts 30 engage the exterior face of plate 20. By loosening the nuts 32 slightly, each vibration motor 20 can be bodily and rotationally adjusted relative to the side wall 11 through a full 360 degrees in a plane parallel to the side wall 11 and parallel to the axis of the motor armature shaft. Each vibration motor can be securely locked in any selected adjusted position by tightening the nuts 32. The rotational adjustment of each motor 20 around the circumference of the ring 27 changes the angle of the motor armature or rotation axis.

During operation of the vibrating screen separator as depicted in FIGS. 1–4, the intensity of vibration can be varied readily without changing the speed of the motor 20. For example, if the two motors 20 are adjusted to positions where their armature shaft axes are parallel to each other and horizontal, or parallel to the floor 33, their vibratory effect across the plane of the screen 10 will be cancelled out to a great extent because of the counter-rotation of the two motors indicated by the arrows 34 in FIG. 2. Since the eccentric weights of the two motors will then be revolving in vertical planes, the screen 10 will have induced vibration in a vertical direction causing solid material undergoing screening to bounce on it.

If both vibration motors 20 are adjusted so that their armature shaft axes are still parallel but are inclined to any chosen degree of inclination, as shown in FIG. 1, lateral or cross-vibration of the screen 10 will still be dampened because of the above-noted cancelling effect. However, because of the angularity of the motors, vibration forces on the screen will be directed with both vertical and horizontal components, and the resultant of these forces will act on the screen at a certain angle, dependent upon the chosen angular adjustment of the motors. In this manner, the vibratory effect on the separator screen may be widely varied.

Additionally, the intensity of vibration can be varied by adjusting the motors 20 rotationally relative to each other rather than in unison so that the armature shaft of one motor will be at a chosen angle to the armature shaft of the opposite side motor. The wider the angle between the two armature shaft axes, the greater the intensity of vibration which will be obtained. Very mild vibration will be induced on the screen when the motor armature shaft axes are parallel, as stated, and when the armature shaft axes are rotated relative to each other through a full 180 degrees, induced vibration of the greatest intensity will be achieved. Suffice it to say that the invention enables changing the frequency and amplitude of vibration of the screen separator by the use of two conventional constant speed motors, as described. Where one such motor only is employed near the center of mass of the vibration assembly, it is not possible to achieve the described variable mode of operation of the present invention.

Figure 5:
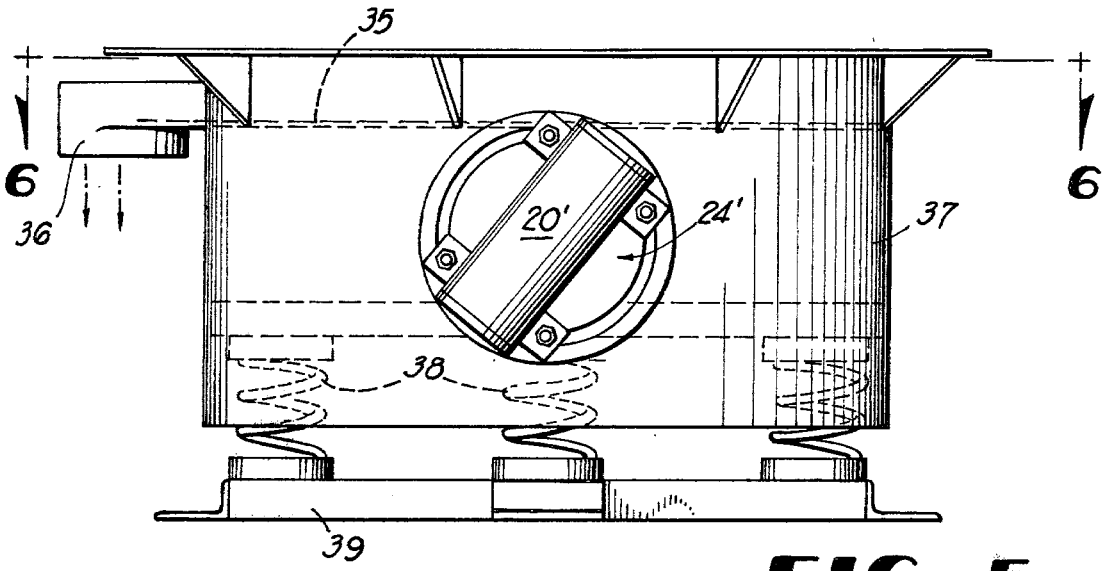
FIG. 5 is a side elevation of the invention embodied in a vertical axis circular separator.
Figure 6:
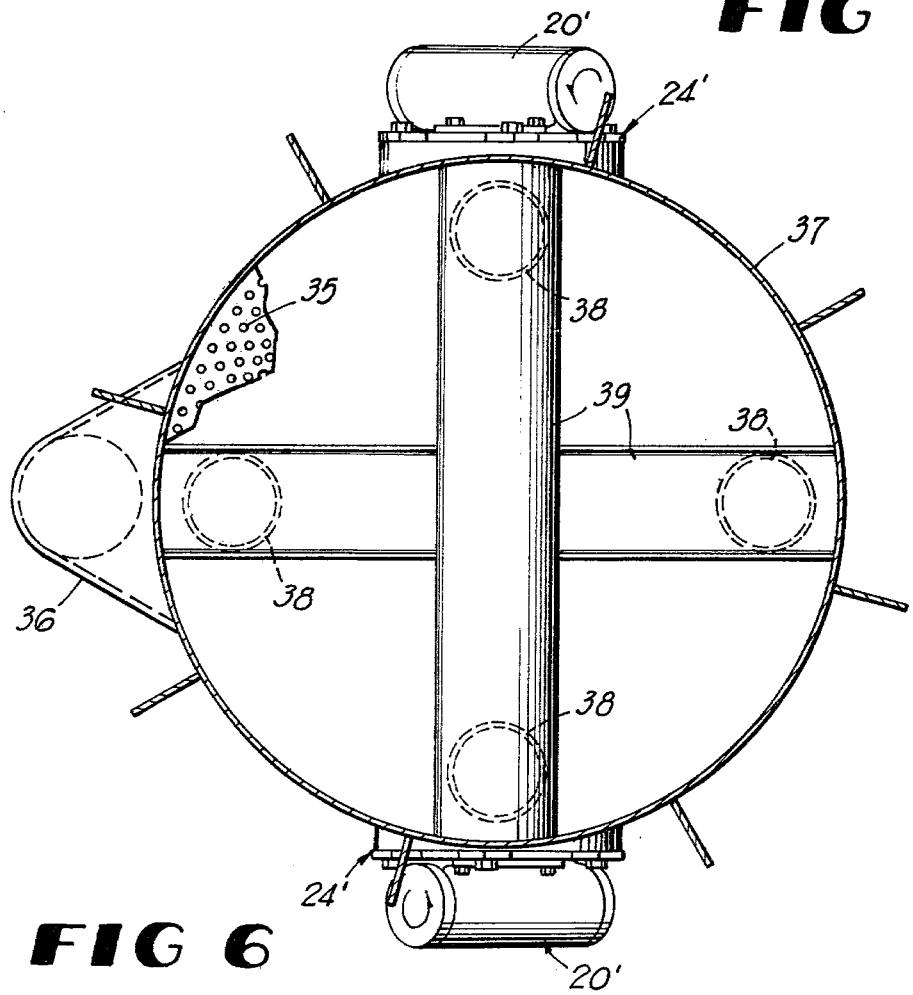
FIG. 6 is a horizontal section taken on line 6—6 of FIG. 5.

Referring to FIGS. 5 and 6 of the drawings, a circular vibrating screen separator is depicted having an upright axis. Such a separator receives material onto its screen 35 at or near the center of the machine and the vibrating material migrates radially outwardly to a material discharge element 36 for oversize material, the smaller material passing through the screen 35. A cylindrical frame or housing 37 is mounted on isolating springs 38 similar to the springs 18, and the springs rest on a level stationary support base 39.

As with the inclined screen separator in FIGS. 1 and 2, the circular upright axis separator employs two opposite side external vibration motors 20' at diametrically opposite points on the circular frame 37. The adjustable swivel mount 24' for each vibration motor 20' is identical to the previously-described mount 24 for motor 20 constructed in accordance with FIGS. 3 and 4, and the description of the swivel mount will not be repeated.

During the operation of the circular upright axis screen separator, while the armature shafts of the two vibration motors 20' are parallel and tilted to an angle of 45 degrees to the horizontal, a bouncing action will be imparted to the material undergoing separation while simultaneously a circular and gradual radial movement of the material toward the outlet 36 will be generated. Tilting of the motors 20' relative to the horizontal in one direction imparts a clockwise movement path to the material looking downwardly toward the screen 35. Tilting the two motors 20' in the opposite direction will generate a counterclockwise movement path to the material on the screen. Again, as with the embodiment in FIGS. 1 and 2, rotational adjustment of the motors 20' relative to each other by means of their swivel mounts 24' will serve to vary the intensity of vibration without actually changing motor speed.

By inducing some bouncing action for the material on the screen 35, it has been found that a substantially greater quantity of material can be processed through the separator in a given time than has heretofore been possible in the prior art.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A vibrating screen separator comprising a vibrating screen assembly having a material inlet and outlet, resilient means supporting the screen assembly for vibratory movement, a vibration motor on the exterior of each opposite side of the screen assembly in opposed alignment with the other vibration motor, and an adjustable and lockable rotational mounting for each vibration motor on each side of the screen assembly whereby each vibration motor is independently rotatable in opposite directions through a full circle of rotation relative to the other vibration motor, and each rotational mounting comprising a disc and a surrounding concentric ring fixed to one side of the screen assembly and defining between them a continuous annular passage, and at least a pair of spaced threaded fasteners carried by each vibration motor and extending into said annular passage and adapted to move through the passage in either direction circumferentially, said threaded fasteners adapted to be clampingly locked in selected adjusted positions relative to the annular passage.

2. A vibrating screen separator as defined in claim 1, and said annular passage having a T-cross section and said threaded fasteners comprising bolts having heads disposed within the wider portion of said passage and shanks disposed within the narrower portion of said passage, and clamping nuts engaged with the screw-threads of said bolts.

3. A vibrating screen separator as defined in claim 1, and a flat mounting plate fixed to each vibration motor in a plane parallel to the motor rotational axis and having spaced apertures formed therethrough receiving said bolts.

* * * * *